US007496992B2

(12) United States Patent
Ausnit

(10) Patent No.: US 7,496,992 B2
(45) Date of Patent: Mar. 3, 2009

(54) LEAKPROOF FASTENER WITH SLIDER

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 207 days.

(21) Appl. No.: 11/173,545

(22) Filed: Jul. 1, 2005

(65) Prior Publication Data

US 2007/0000098 A1 Jan. 4, 2007

(51) Int. Cl.
*A44B 19/26* (2006.01)
*A44B 19/16* (2006.01)
*B65D 33/16* (2006.01)

(52) U.S. Cl. ..... 24/30.5 R; 24/400; 24/415

(58) Field of Classification Search ..... 24/30.5 R, 24/399, 400, 585.1–585.12; 383/63, 64, 383/61.1, 61.2, 61.3, 61.5, 65
See application file for complete search history.

(56) References Cited

U.S. PATENT DOCUMENTS 2,637,086 A * 5/1953 Philips ..... 24/382
6,088,887 A * 7/2000 Bois ..... 24/399
6,220,754 B1 * 4/2001 Stiglic et al. ..... 24/415
6,305,844 B1 * 10/2001 Bois ..... 24/399
6,461,042 B1 * 10/2002 Tomic et al. ..... 383/64
6,481,890 B1 * 11/2002 VandenHeuvel ..... 24/585.12
6,817,763 B2 * 11/2004 Tomic ..... 24/400
6,902,321 B2 * 6/2005 Bois ..... 24/399
6,915,546 B2 * 7/2005 Kasai ..... 24/30.5 R
7,090,397 B2 * 8/2006 Stolmeier ..... 383/64
2004/0045138 A1 * 3/2004 Kasai ..... 24/399
2006/0120630 A9 * 6/2006 Ausnit et al. ..... 383/64

FOREIGN PATENT DOCUMENTS

WO WO 03/022697 * 3/2003 ..... 24/399

* cited by examiner

*Primary Examiner*—Robert J Sandy
*Assistant Examiner*—Ruth C Rodriguez
(74) *Attorney, Agent, or Firm*—Day Pitney LLP

(57) ABSTRACT

The present disclosure relates a leakproof or leak-resistant zipper with profiles which include an inter-engaging element with inter-engaging fingers and a leakproof or leak-resistant structure. The slider, when moved in the closing direction, urges the fingers of one profile to inter-engage with the fingers of the other profile and further urges the elements of the leakproof or leak-resistant structure into engagement with each other. The slider, when moved in the opening direction, separates the inter-engaging fingers of the inter-engaging elements and further allows the elements of the leakproof or leak-resistant structure to separate.

18 Claims, 3 Drawing Sheets

LEAKPROOF FASTENER WITH SLIDER

BACKGROUND OF THE INVENTION

1. Field of the Invention

The present invention relates to a leakproof or leak-resistant fastener with a slider, such as is used as the zipper in a reclosable container.

2. Description of the Prior Art

In the prior art, the slider-operated zippers are well-known for reclosable bags. While this art is well-developed and has proven satisfactory for its intended purposes, further improvements are desired with respect to maintaining the leakproof integrity of such reclosable bags. As recognized in U.S. Pat. No. 6,761,481 entitled "Bag Comprising Matching Closing Sections Actuated by a Slider", and its numerous progeny applications, certain deficiencies in the sealing can occur when the zipper profiles or strips remain in a separated configuration ahead of the slider. This can be problematic for reclosable bags which contain liquids, gels, fine particulates or frozen foods.

OBJECTS AND SUMMARY OF THE INVENTION

It is therefore an object of the present invention to provide improvements in the leakproof characteristics of slider-operated zippers.

This and other objects are attained by providing a slider-operated zipper with first and second interlocking profiles. The illustrated profiles terminate in inter-engaging elements which include at least two finger elements terminating in detent hooks. However, single finger elements could also be used. The detent hooks of the first profile inter-engage with the detent hooks of the second profile in the inter-engaged position. The inter-engaging elements are brought together in an inter-engaged or closed position by the slider moving in a first direction. Likewise, the inter-engaging elements are separated from each other to result in the open position by the slider moving in a second direction, opposite to the first direction.

Additionally, a leakproof or leak-resistant structure is formed on the profiles inwardly adjacent from the inter-engaging elements. The first profile has a female groove-like element while the second profile has a male arrowhead-like or wedge element which is engaged by the female element. The slider is configured to urge the male element into the female element when the slider is moved in a closing direction. After the slider has been moved in an opening direction, the male and female elements of the leakproof or leak-resistant structure will separate as there is no structure to hold the elements in the engaged configuration.

DESCRIPTION OF THE DRAWINGS

Further objects and advantages of the invention will become apparent from the following description and claims, and from the accompanying drawings:

DETAILED DESCRIPTION OF THE PREFERRED EMBODIMENTS

Figure 1:
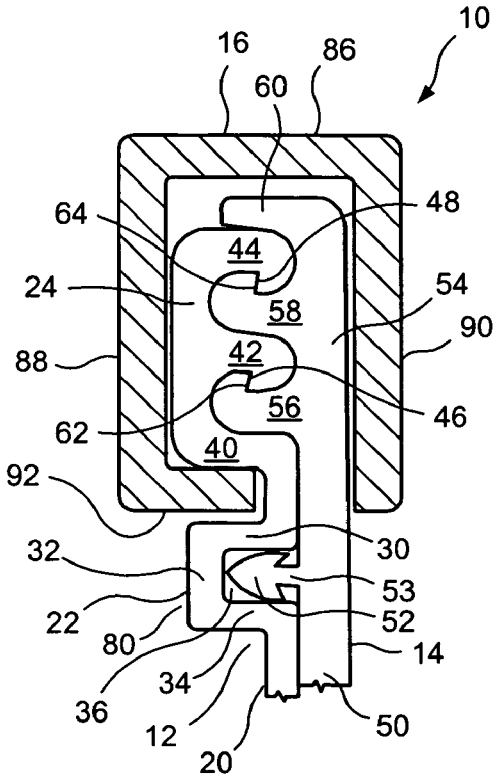
FIG. 1 is a cross-sectional view of the slider-operated zipper of the present invention, shown in the closed or inter-engaged position at the closing end of the slider.

Referring now to the drawings in detail wherein like numerals indicate like elements throughout the several views, one sees that FIG. 1 is a cross-sectional view of the slider-operated zipper 10 of the present invention, in the closed or inter-engaged configuration. Slider-operated zipper 10 includes first profile 12, second profile 14 and slider 16.

First profile 12 includes first flange portion 20 with groove-like female element 22 and further includes first inter-engaging head 24. First flange portion 20 attaches to a first bag wall (not shown). Groove-like female element 22 includes upper rib 30, rear wall 32 and lower rib 34 thereby bounding groove 36. First inter-engaging head 24 includes lower guide wall 40 and first and second inter-engaging fingers 42, 44. First and second inter-engaging fingers 42, 44 terminate in respective first and second detent hooks 46, 48.

Second profile 14 includes second flange portion 50 with arrowhead-like or wedge male element 52 and further includes second inter-engaging head 54 which includes third and fourth inter-engaging fingers 56, 58 and upper guide wall 60. Second flange portion 50 attaches to a second bag wall (not shown). Third and fourth inter-engaging fingers 56, 58 terminate in respective third and fourth detent hooks 62, 64.

Figure 2:
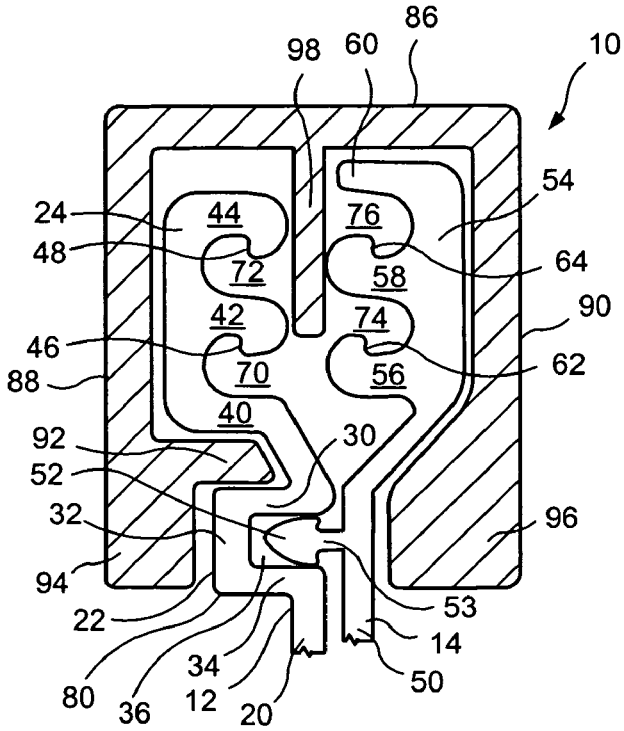
FIG. 2 is a cross-sectional view of the slider-operated zipper of the present invention, at the opening end of the slider with the zipper disengaged.
Figure 3:
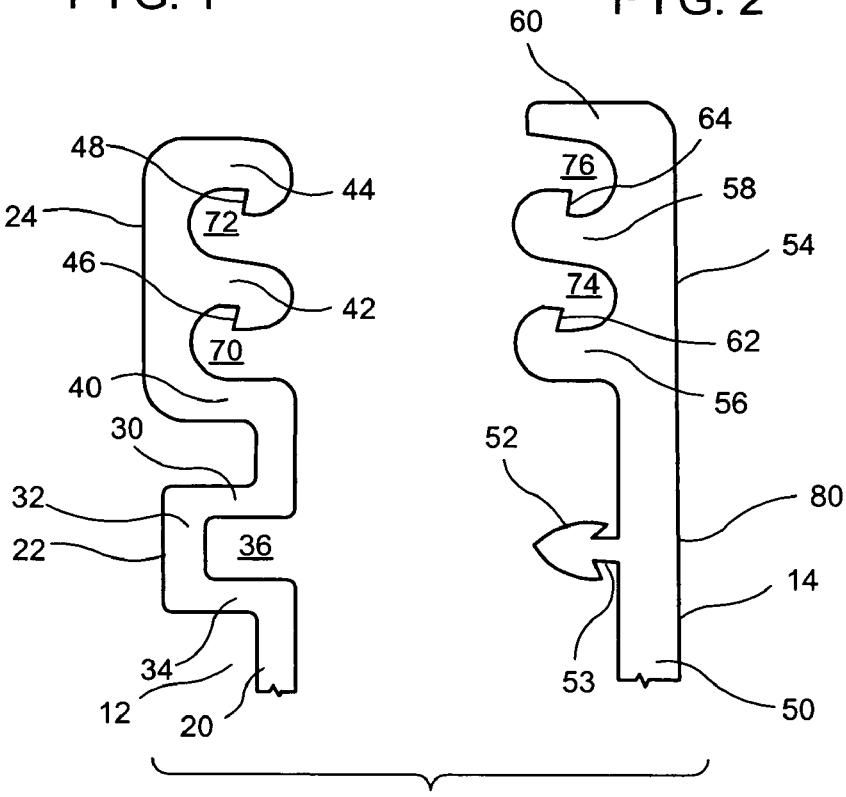
FIG. 3 is a cross-sectional view of the zipper of the present invention, shown with the profiles separated from each other, without the slider.

As shown in FIG. 2, the opening end of slider 16 is wider than the closing end of slider 16. First space 70 is formed between lower guide wall 40 and first inter-engaging finger 42. Second space 72 is formed between first and second inter-engaging fingers 42, 44. Third space 74 is formed between third and fourth inter-engaging fingers 56, 58 and fourth space 76 is formed between fourth inter-engaging finger 58 and upper guide wall 60. Spaces 70, 72, 74, 76 are complementary in shape so as to receive third, fourth, first and second inter-engaging fingers 56, 58, 42, 44, respectively, in the inter-engaged position shown in FIG. 1 with first and second detent hooks 46, 48 engaging respective third and fourth detent hook 62, 64.

Figure 4:
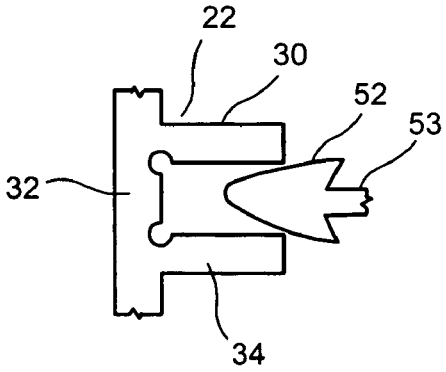
FIG. 4 is a cross-sectional view of a first embodiment of the leakproof or leak-resistant structure, as the arrowhead-like or wedge element is inserted into the groove-like element.
Figure 5:
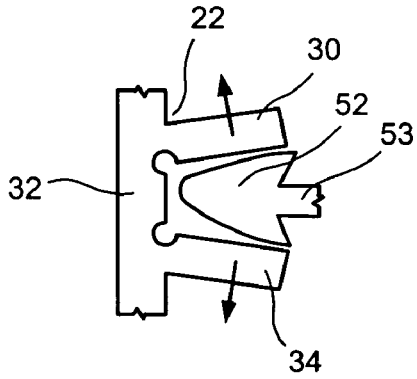
FIG. 5 is a cross-sectional view of the first embodiment of the leakproof or leak-resistant element, with the arrowhead-like or wedge element inserted and the walls of the groove-like element spreading apart.
Figure 6:
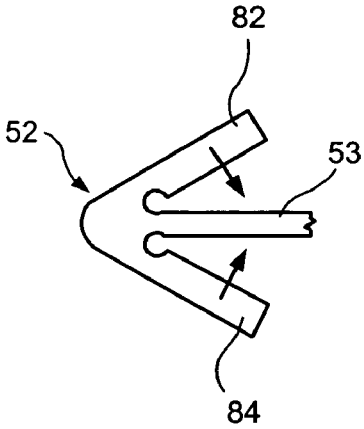
FIG. 6 is a cross-sectional view of a second embodiment of the leakproof or leak-resistant structure, as the arrowhead-like or wedge element is inserted into the groove-like element.
Figure 7:
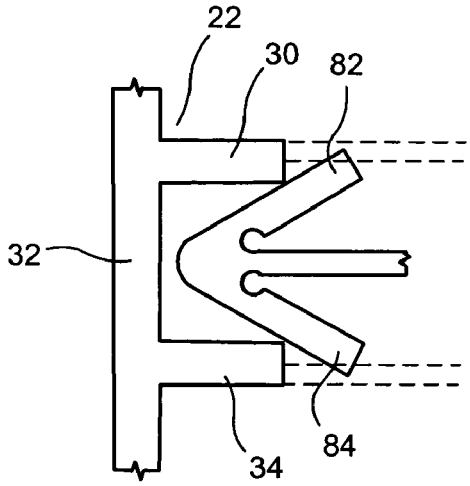
FIG. 7 is a cross-sectional view of the arrowhead-like or wedge element of the second embodiment of the leakproof or leak-resistant structure, illustrating the flexible resilience of the sides of the arrowhead-like or wedge element in this embodiment.

Female groove-like element 22 and male arrowhead-like or wedge element 52 form leakproof structure 80. Female groove-like element 22 and male arrowhead-like element 52 are typically free of detent engagement elements. Arrowhead-like or wedge element 52 is supported by stem 53 and is sized to spread the upper and lower ribs 30, 34 of groove-like element 22 as it is inserted therein as shown in FIGS. 4 and 5, thereby forming a leakproof, or leak-resistant engagement as shown in FIGS. 1 and 2 (FIGS. 4 and 5 further illustrating an embodiment where upper and lower ribs 30, 34 are hinged and FIGS. 4, 5, 7 and 9 further illustrating an embodiment where rear wall 32 is co-linear with first flange 20). Alternately, as shown in FIGS. 6 and 7, upper and lower ribs 30, 34 can be more rigid or stiff with male arrowhead-like or wedge element 52 including hinged or otherwise flexible resilient wings 82, 84 which deflect inwardly when they are urged between upper and lower ribs 30, 34, and, through their resilience, form the leakproof or leak-resistant engagement. In this alternative configuration, there is minimal deflection of upper and lower ribs 30, 34 in the engaged configuration.

Moreover, after the slider 16 separates the first and second inter-engaging heads 24, 54 as shown in FIG. 2, the elements 22, 52 of leakproof structure 80 likewise separate as there is nothing to retain elements 22, 52 in the engaged configuration. As will be described hereinafter, when the slider 16 urges first and second inter-engaging heads 24, 54 into the inter-engaged position as shown in FIG. 1, slider 16 likewise urges elements 22, 52 of leakproof structure 80 into an engaged configuration.

As shown in FIGS. 1 and 2, slider 16 includes top wall 86 with first and second side walls 88, 90 extending therefrom. Slider retaining flange 92 extends from a lower portion of first side wall 88 to impinge first profile 12 between groove-like female element 22 and first inter-engaging head 24 in order to urge the leakproof structure 80 into an engaged configuration in both the closing end cross-sectional view of FIG. 1 and the opening end cross-sectional view of FIG. 2. Slider retaining flange 92 further acts to retain slider 16 on zipper 10 with slider retaining flange 92 being positioned between first and second inter-engaging heads 24, 54 and leakproof structure 80. As shown in FIG. 2, the opening end of slider 1 further includes first and second side wall extensions 94, 96 to maintain the leakproof structure 80 in its engaged configuration even as first and second inter-engaging heads 24, 54 are separated. Furthermore, opening end of slider 16 includes separating finger 98 extending from a mid-portion of top wall 86 in order to separate the first and second inter-engaging heads 24, 54.

Figure 8:
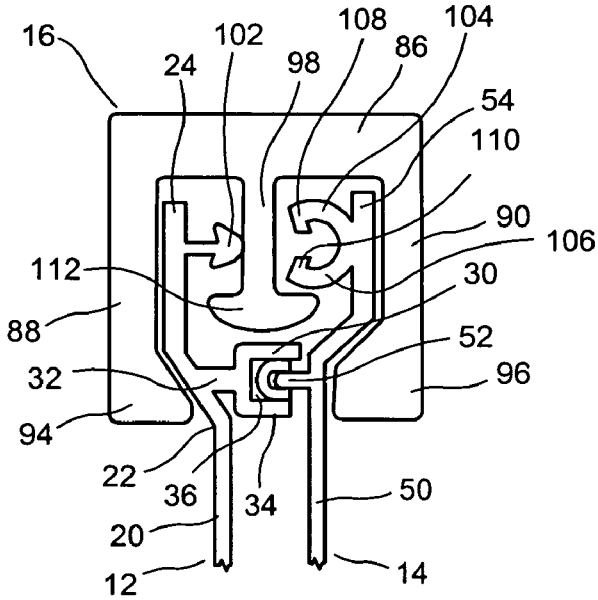
FIG. 8 is a cross-sectional view of an alternative embodiment of the slider-operated zipper of the present invention, including a single finger and two hooks.

FIG. 8 illustrates a further embodiment of the present invention wherein first inter-engaging head 24 includes a single arrowhead-shaped male element 102 and second inter-engaging head 54 includes a female element formed from walls 104, 106 which terminate in detent hooks 108, 110, respectively, to engage the arrowhead-shaped male element 102. Further illustrated in this embodiment is retaining flange 112 on the lower or distal end of separator finger 98. Retaining flange 112 maintains slider 16 on zipper 10.

Figure 9:
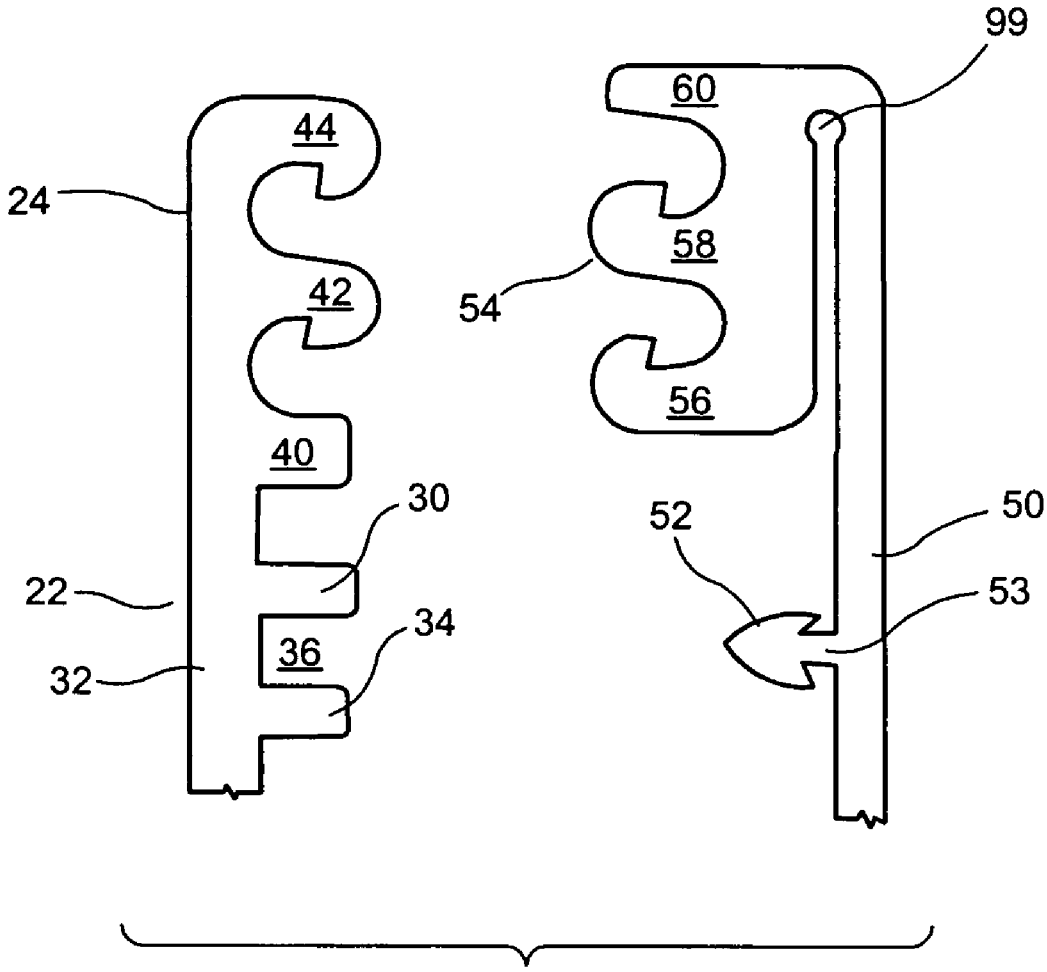
FIG. 9 is a cross-sectional view of a further alternative embodiment of the slider-operated zipper of the present invention, including a hinge construction.

FIG. 9 illustrates a still further embodiment of the present invention wherein second flange 50 is hinged a hinging point 99 of the top of second inter-engaging head 54. Additionally, rear wall 32 of female groove-like element 22 is co-linear with first flange 20.

The resulting structure can be used with a reclosable bag wherein the slider 16 moving in the closing direction urges the first and second inter-engaging heads 24, 54 into the engaged position as well as urging the leakproof structure 80 into the engaged position as shown in FIG. 1. The movement of slider 16 in the opening direction separates first and second inter-engaging heads 24, 54. Likewise, after the first and second inter-engaging heads 24, 54 are separated, elements 22, 52 of leakproof structure 80 separate as there is nothing to hold them in the engaged configuration.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package, including:

a first profile including a first flange and a male leak-resistant element and terminating in a first inter-engaging element, wherein said male leak-resistant element includes a wedge element;

a second profile including a second flange and a female leak-resistant element and terminating in a second inter-engaging element, wherein said female leak-resistant element includes two opposed parallel ribs forming a grooved structure;

a slider which, when moving in a closing direction, urges said first and second inter-engaging elements into inter-engagement with each other and urges said male leak-resistant element into insertion within said grooved structure of said female leak-resistant element, and when moving in an opening direction; separates said first and second inter-engaging elements from each other;

wherein said slider includes a slider retaining flange impinging against at least one of said first and second profiles at a location between and separated from said inter-engaging elements and said leak-resistant elements;

wherein said male and female leak-resistant elements are free of detent engagement elements whereby movement of said slider in said opening direction allows separation of said male leak-resistant element from said female leak-resistant element;

wherein said slider includes a top wall and first and second side walls extending therefrom, and wherein said slider retaining flange extends from said first side wall in order to maintain engagement between said male and female leak-resistant elements; and wherein said slider includes an opening end wherein said first and second inter-engaging elements are separated and a closing end wherein said first and second inter-engaging elements are inter-engaged with each other, and wherein first and second side walls include respective first and second side wall extensions at said opening end, urging against said first and second leak-resistant elements.

2. The zipper of claim 1 wherein said first inter-engaging elements includes a first plurality of fingers terminating in first detent hooks and said second inter-engaging element includes a second plurality of fingers terminating in second detent hooks wherein, when said first and second inter-engaging elements are in inter-engagement with each other, said first plurality of fingers are inter-engaged with said second plurality of fingers, whereby said first detent hooks engage respective second detent hooks.

3. The zipper of claim 1 wherein at least one of said first and second flanges is hinged against at least one of said first and second inter-engaging elements.

4. The zipper of claim 1 wherein said opening end is wider than said closing end.

5. A zipper for a reclosable package, including:

a first profile including a first flange and a male leak-resistant element and terminating in a first inter-engaging element, wherein said male leak-resistant element includes a wedge element and a stem supporting said wedge element;

a second profile including a second flange and a female leak-resistant element and terminating in a second inter-engaging element, wherein said female leak-resistant element includes two opposed parallel ribs forming a grooved structure;

wherein said first inter-engaging element includes a first plurality of fingers terminating in first detent hooks and said second inter-engaging element includes a second plurality of fingers terminating in second detent hooks wherein, when said first and second inter-engaging elements are in inter-engagement with each other, said first plurality of fingers are inter-engaged with said second plurality of fingers, whereby said first detent hooks engage respective second detent hooks;

a slider which, when moving in a closing direction, urges said first and second inter-engaging elements into inter-engagement with each other and urges said male leak-resistant element into insertion within said grooved structure of said female leak-resistant element, and when moving in an opening direction, separates said first and second inter-engaging elements from each other;

wherein said male and female leak-resistant elements are free of detent engagement elements whereby movement of said slider in said opening direction allows separation of said male leak-resistant element from said female leak-resistant element;

wherein said slider includes a top wall and first and second side walls extending therefrom, and wherein said slider retaining flange extends from said first side wall in order to maintain engagement between said male and female leak-resistant elements; and wherein said slider includes an opening end wherein said first and second inter-engaging elements are separated and a closing end wherein said first and second inter-engaging elements are inter-engaged with each other, and wherein first and second side walls include respective first and second side wall extensions at said opening end, urging against said first and second leak-resistant elements.

6. The zipper of claim 5 wherein said ribs are hinged to permit spreading of said ribs of said grooved structure.

7. The zipper of claim 5 wherein sides of said male element are hinged to permit resilient inward deflection thereof.

8. The zipper of claim 7 wherein said ribs are relatively stiff whereby said male element, upon insertion between said ribs, deflects inward with minimal deflection of said ribs.

9. The zipper of claim 5 wherein sides of the male element are flexible to permit resilient inward deflection thereof.

10. The zipper of claim 9 wherein said ribs are relatively stiff whereby said male element, upon insertion between said ribs, deflects inwardly with minimal deflection of said ribs.

11. A zipper for a reclosable package, including:

a first profile including a first flange and a male leak-resistant element and terminating in a first inter-engaging element, wherein said male leak-resistant element includes a wedge a second profile including a second flange and a female leak-resistant element and terminating in a second inter-engaging element, wherein said female leak-resistant element includes two opposed parallel ribs forming a grooved structure;

a slider which, when moving in a closing direction, urges said first and second inter-engaging elements into inter-engagement with each other and urges said male leak-resistant element into insertion within said grooved structure of said female leak-resistant element, and when moving in an opening direction, separates said first and second inter-engaging elements from each other;

wherein said slider includes a slider retaining flange impinging against at least one of said first and second profiles at a location between and separated from said inter-engaging elements and said leak-resistant elements; and wherein said male and female leak-resistant elements are free of detent engagement elements whereby movement of said slider in said opening direction allows separation of said male leak-resistant element from said female leak-resistant element;

wherein said slider includes a top wall, first and second side walls extending from said top wall and a separating finger extending from said top wall for separating said first inter-engaging element from said second inter-engaging element, said separating finger terminating in said slider retaining; and wherein said slider includes an opening end wherein said first and second inter-engaging elements are separated and a closing end wherein said first and second inter-engaging elements are inter-engaged with each other, and wherein first and second side walls include respective first and second side wall extensions at said opening end, urging against said first and second leak-resistant elements.

12. A zipper for a reclosable package, including:

a first profile including a first zipper flange, a first leak-resistant element and a first inter-engaging element, said first leak-resistant element including a wedge shape;

a second profile including a second zipper flange, a second leak-resistant element and a second inter-engaging element, said second leak-resistant element including a channel with opposed parallel walls for receiving said first leak-resistant element;

a slider which, when moving in a closing direction, urges said first and second inter-engaging elements into inter-engagement with each other, and when moving in an opening direction, separates said first and second inter-engaging elements from each other;

wherein said slider includes a first slider flange which urges against said first zipper flange at a position between and separated from said first inter-engaging element and said first leak-resistant element;

wherein said slider includes a top wall and first and second side walls extending therefrom, and wherein said slider retaining flange extends from said first side wall in order to maintain engagement between said male and female leak-resistant elements; and wherein said slider includes an opening end wherein said first and second inter-engaging elements are separated and a closing end wherein said first and second inter-engaging elements are inter-engaged with each other, and wherein first and second side walls include respective first and second side wall extensions at said opening end, urging against said first and second leak-resistant elements.

13. The zipper of claim 12 wherein said first leak-resistant element engages said second leak-resistant element when said first and second inter-engaging elements are in an inter-engaged configuration.

14. The zipper of claim 13 wherein said first slider flange urges said first and second leak-resistant elements into an engaged configuration.

15. The zipper of claim 14 further including a second slider flange which urges against said second zipper flange at a position between said second inter-engaging element and said second leak-resistant element.

16. The zipper of claim 15 wherein said first and second slider flanges are opposed to each other.

17. The zipper of claim 16 wherein said first and second slider flanges retain said slider on said first and second profiles.

18. The zipper of claim 17 wherein said first and second leak-resistant elements are free of detent engagement elements whereby movement of said slider in said opening direction allows separation of said first and second leak-resistant elements from each other.

* * * * *